US007976332B2

(12) United States Patent
Matsumura et al.

(10) Patent No.: US 7,976,332 B2
(45) Date of Patent: Jul. 12, 2011

(54) LIF CONNECTOR

(75) Inventors: Kaoru Matsumura, Makinohara (JP); Kazuto Ohtaka, Makinohara (JP); Hideki Homma, Tokyo (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/749,649

(22) Filed: Mar. 30, 2010

(65) Prior Publication Data

US 2010/0248528 A1 Sep. 30, 2010

(30) Foreign Application Priority Data

Mar. 31, 2009 (JP) ..... 2009-085911

(51) Int. Cl.
*H01R 13/64* (2006.01)

(52) U.S. Cl. ..... 439/374

(58) Field of Classification Search ..... 439/374, 439/352, 489, 357, 589, 587
See application file for complete search history.

(56) References Cited

U.S. PATENT DOCUMENTS

| | | | | |
|---|---|---|---|---|
| 5,775,930 | A * | 7/1998 | Model et al. | 439/352 |
| 6,257,935 | B1 * | 7/2001 | Zhang et al. | 439/680 |
| 6,338,651 | B1 * | 1/2002 | Svette et al. | 439/559 |
| 6,749,459 | B2 * | 6/2004 | Urbaniak et al. | 439/496 |
| 7,347,710 | B2 * | 3/2008 | Ohtaka et al. | 439/352 |

FOREIGN PATENT DOCUMENTS

JP 2004-103557 A 4/2004

* cited by examiner

*Primary Examiner* — Jean F Duverne
(74) *Attorney, Agent, or Firm* — Sughrue Mion, PLLC

(57) ABSTRACT

A connector comprising a first connector provided with a first projection and a second projection on an outer surface thereof; and a frame including a wall portion defining an opening, the wall portion provided with a first guide running in a direction and a second guide on an inner surface thereof, wherein the first connector is inserted into the frame through the opening along the direction while the first projection is guided by the first guide and the second projection is guided by the second guide, and at least a part of a distance between the first guide and the second guide shortens along the direction.

10 Claims, 9 Drawing Sheets

LIF CONNECTOR

CROSS-REFERENCE TO RELATED APPLICATIONS

This application claims priority from Japanese Patent Application No. 2009-085911 filed on Mar. 31, 2009, the entire subject matter of which is incorporated herein by reference.

TECHNICAL FIELD

This invention relates to a LIF (Low Insertion Force) connector having an LIF mechanism. By the LIF mechanism, male and female multi-pole connectors each having many metal terminals are fitted together with a low insertion force.

BRIEF DESCRIPTION OF THE RELATED ART

A related LIF connector is described in JP-A-2004-103557. In FIG. 9, the relate LIF connector 1 is designed to be fixed to a panel member (not shown) such for example as a vehicle body panel. More specifically, the LIF connector 1 comprises a tubular connector holder 2 to be mounted on the panel member, a second connector 3 to be received and fixed in the connector holder 2, a first connector 4 for being fitted to the second connected 3 fixed to the connector holder 2, and a lever member 5 pivotally mounted on the first connector 4 so as to rotate to fit the first connector 4 to the second connector 3.

The first connector 4 has a pair of fulcrum bosses 7 formed respectively on opposite outer surfaces of a first connector housing 6. On the other hand, the lever member 5 includes a pair of wall-like lever function portions 8 opposed respectively to the opposite outer surfaces of the first connector housing 6, and a lever operating portion 9 interconnecting the pair of lever function portions 8. The pair of lever function portions 8 are respectively provided with fulcrum boss guide holes 10. Each of the fulcrum bosses 7 is fitted in the fulcrum boss guide hole 10, respectively. The lever member 5 has a generally L-shape as a whole. The lever member 5 is formed into such a size that the lever member does not interfere with a lock portion of the first connector 4 (which is locked to the second connector 3 when the first and second connectors 4 and 3 are fitted together) at the time of attaching the lever member 5 to the first connector 4 and also during the pivotal movement of the lever member 5.

In the above described related art, the pair of fulcrum bosses 7 project from the first connector housing 6. Therefore it is necessary to insert the first connector 4 between the pair of lever function portions 8 while forcibly expanding the distance between the pair of lever function portions 8, when attaching the lever member 5 to the first connector 4. Also, it is necessary to attach the lever member 5 to the first connector 4 in such a manner that this lever member 5 is positioned at a predetermined position. Therefore, there is a problem that the efficiency of the attaching operation is usually low unless a jig is used (If the jig is not used, the attaching operation requires much skill.).

Furthermore, in the above related art, the lever member 5 is relatively large in size so as not to interfere with the lock portion. Therefore there is a problem that the LIF connector 1 becomes large in size.

Furthermore, since the LIF connector 1 of the above related art comprises four members: the connector holder 2, the first connector 4, the second connector 3 and the lever member 5, the number of the component parts of the LIF connector 1 is large. The increased number of the component parts also causes a problem that much time and labor are required for assembling the LIF connector 1 and for fixing this connector to the panel member.

SUMMARY

This invention has been made in view of the above circumstances, and addressed above problems. The exemplary embodiments of the present invention are LIF connectors in which the efficiency of an operation for attaching a lever member to a connector is improved. Another exemplary embodiments of the present invention are LIF connectors which can be formed into a compact size, and include a small number of component parts, and can be retained on a panel member.

An exemplary embodiment of the present invention is a connector comprising a first connector provided with a first projection and a second projection on an outer surface thereof; and a frame including a wall portion defining an opening, the wall portion provided with a first guide running in a direction and a second guide on an inner surface thereof, wherein the first connector is inserted into the frame through the opening along the direction while the first projection is guided by the first guide and the second projection is guided by the second guide, and at least a part of a distance between the first guide and the second guide shortens along the direction.

In the exemplary embodiment, preferably, the first guide comprises: a first guide groove; a guide hole; and a projection path having a tapered surface and provided between the guide groove and the guide hole.

In the exemplary embodiment, preferably, the first projection is provided with an projection which is projected from a tip of the first projection, and the guide hole is provided with a space to which the projection is fitted.

In the exemplary embodiment, preferably, the second guide comprises: a first parallel portion running in the direction; an inclined portion continued from the first parallel portion and inclined from the direction; and a second parallel portion running in the direction and continued from the inclined portion.

In the exemplary embodiment, preferably, a pair of the first projections are provided on the outer surface of the first connector.

In the exemplary embodiment, preferably, a pair of the second projections are provided on the outer surface of the first connector.

In the exemplary embodiment, preferably, the connector comprises: the first connector provided with a second guide groove; the frame provided with a third guide groove, the third guide groove having a first end and a second end, a distance between the guide hole and the third guide groove lengthening from the first end to the second end; and a second connector provided with a third projection, the third projection engaged with the first end while the first connector in a first position and engaged with the second end while the first connector in a second position, wherein the first connector is rotatable about the guide hole at least from the second position to the first position.

In the above described exemplary embodiment, at the time of attaching the first connector to the frame, the first projection (about which the frame can rotate) moves substantially straight in the direction toward the guide hole while guided by the first guide grooves of the first guide provided on the frame. At this time, the second projection of the first connector are guided by the second guide of the frame. The operation for attaching the first connector to the frame proceeds, the first connecter is automatically rotated about the first projection by a predetermined angle because of the shortening distance between the first guide and the second guide. In the exemplary embodiment, the shortening distance between the first guide and the second guide is realized by the exemplary structure of the second guide which includes two parallel portions and an inclined portion therebetween. When the first connector is thus automatically rotated and its posture is changed, the interference between the first connector and the frame can be prevented (for example interference between the frame and a lock portion of the first connector as described in later). Preferably, the first connector is rotated into a position where the first connector assumes such a posture as to be suitably fitted to the second connector.

The attaching operation further proceeds, and immediately before the first projection is fitted into the guide hole, the first projection slide over the projection path. The lever member is forcibly expanded only at this time during the attachment of the first connector to the frame (The frame is not always forcibly expanded.). Then, when the first projection is fitted into the guide hole, the operation for attaching the first connector to the lever member is completed, and in this condition the first connector can be fitted to the second connector.

In the exemplary embodiment, preferably, the frame is provided with a third guide on the inner surface thereof. The third guide guides the second projection when the first connector rotate from the second position to the first position. Preferably, the third guide is adjacent to the second guide.

In the exemplary embodiment, after the first connector is attached to the frame, the frame rotates to draw the second connector toward the first connector to fit the two connectors each other. As a result, the second projection of the first connector so far disposed at and guide by the second guide of the frame is guided into the third guide. When the second projection are thus guided into the third guide, the first and second connectors fitted to each other are prevented from being accidentally rotate relative to each other.

In the exemplary embodiment, preferably, the frame is formed into a generally tubular shape so that the first connector can be received in the frame and also that the first connector and the second connector fitted together can be received in the frame, and the frame has an arm for retaining the frame to a panel of vehicle and a flange for retaining the frame to the panel.

In the exemplary embodiment, the connector can be retained on a mounting member (such as a panel member) through the frame. When the frame is retained on the mounting member, the frame works also as a connector holder.

According to an illustrative exemplary embodiment of the present invention, there are provided the first projection (preferably in pair), the second projection (preferably in pair), the first guide (preferably in pair) including boss guide hole, the guide groove, and the projection path, and the second guide (preferably in pair). With this construction, the operation for attaching the first connector to the frame can be more easily performed as compared to the related connector. In the exemplary embodiment, it is not necessary to use a jig for the attaching operation, and therefore there is achieved an advantage that the workability of the attaching operation can be improved as compared to the related connector.

Furthermore, according to the illustrative exemplary embodiment of the invention, the first connector is automatically rotated by a predetermined angle during the operation for attaching the first connector to the frame. Therefore, there is an advantage that the frame can be prevented from interfering with a part of the first connector (for example a lock portion) without the need for increasing the size of the lever member. Therefore, the size of the frame and the size of the LIF connector can be reduced.

Furthermore, according to the illustrative exemplary embodiment of the invention, by further providing the third guide, there is an advantage that the first and second connectors disposed in the fitted condition can be prevented from rotation relative to each other.

Furthermore, according to the illustrative exemplary embodiment of the invention, the frame works also as the connector holder, and therefore the number of the component parts of the LIF connector to be retained on the mounting member (such for example as a vehicle body panel) can be reduced as compared to the related connector. Therefore, according to the exemplary embodiment, advantageously, there can be provided the LIF connector having a reduced number of component parts.

DETAILED DESCRIPTION OF EXEMPLARY EMBODIMENT

An exemplary embodiment of the present invention is explained below with reference to drawings.

In the exemplary embodiment, a first connector of an LIF connector is provided with a pair of fulcrum bosses and a pair of rotationally-mounting projections. A lever member of the LIF connector is provided with a pair of fulcrum boss guide holes, a pair of fulcrum boss introduction guide grooves, a pair of fulcrum boss passage portions and a pair of rotationally-mounting portions. The LIF connector comprises three members, that is, the first connector, a second connector and the lever member. The LIF connector, though comprising the three component members, can be retainingly mounted on a mounting member such for example as a panel member. Namely, the lever member is so constructed as to function also as a connector holder.

The fulcrum bosses are exemplary embodiments of the first projection. The rotationally-mounting projections are exemplary embodiments of the second projection. The lever member is an exemplary embodiment of the frame. The fulcrum boss introduction guide grooves are exemplary embodiments of the first guide. The rotationally-mounting portions are exemplary embodiments of the second guide.

Figure 1:
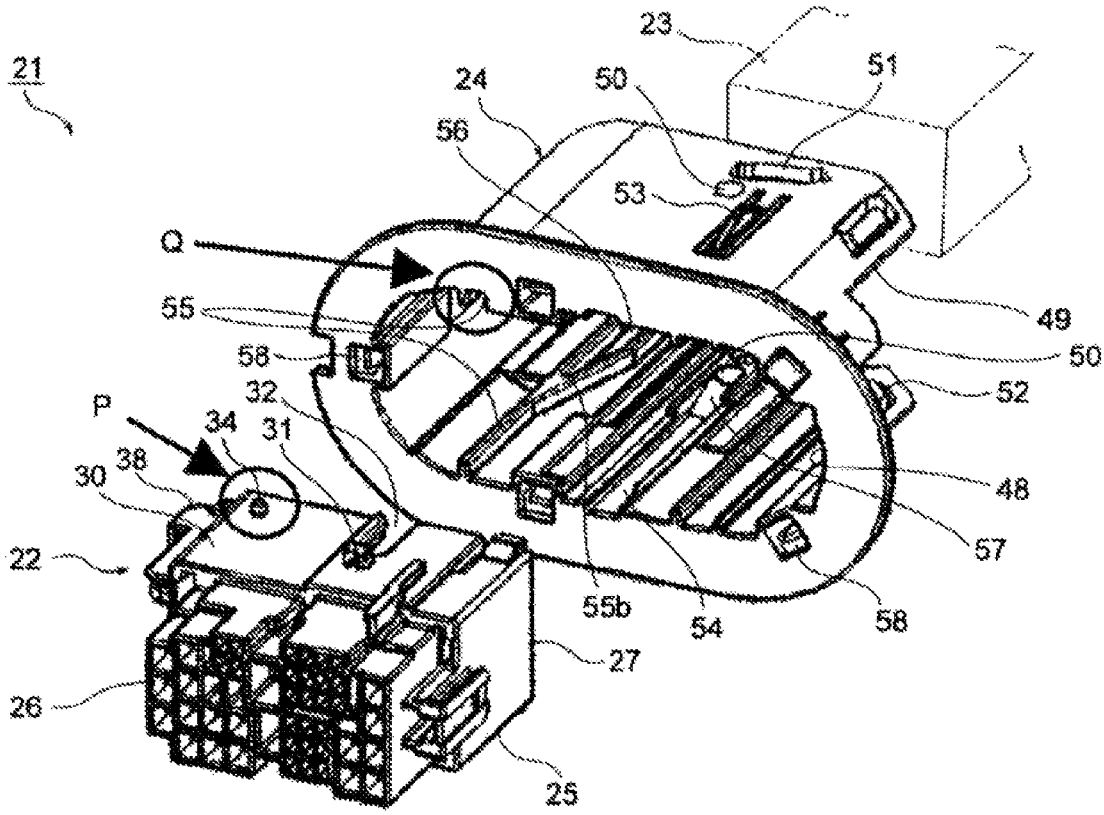
FIG. 1 is a perspective view showing a first connector and a lever member of an LIF connector of the exemplary embodiment.
Figure 2:
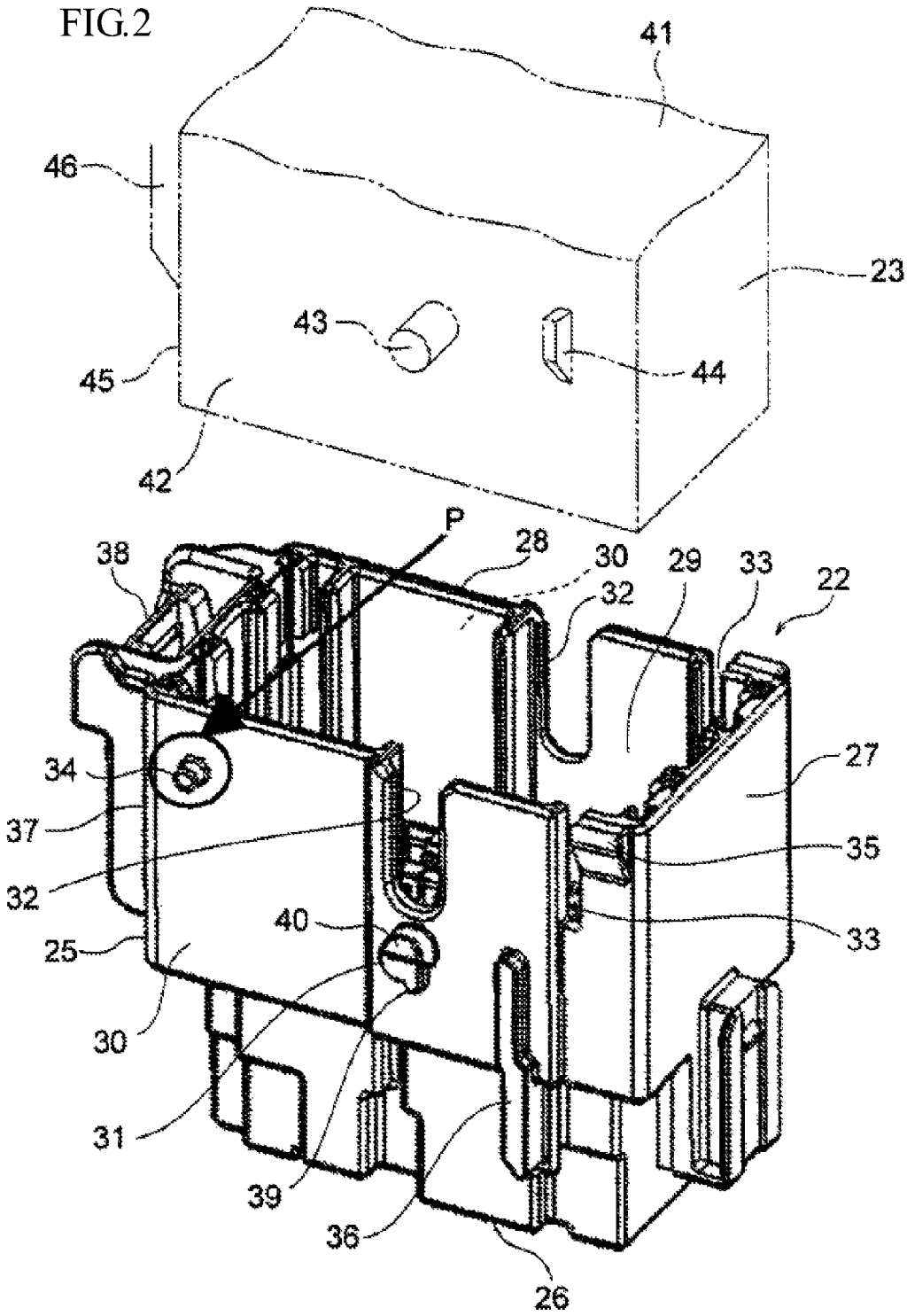
FIG. 2 is a perspective view showing the first connector and a second connector (schematically shown) of the LIF connector of the exemplary embodiment.
Figure 3:
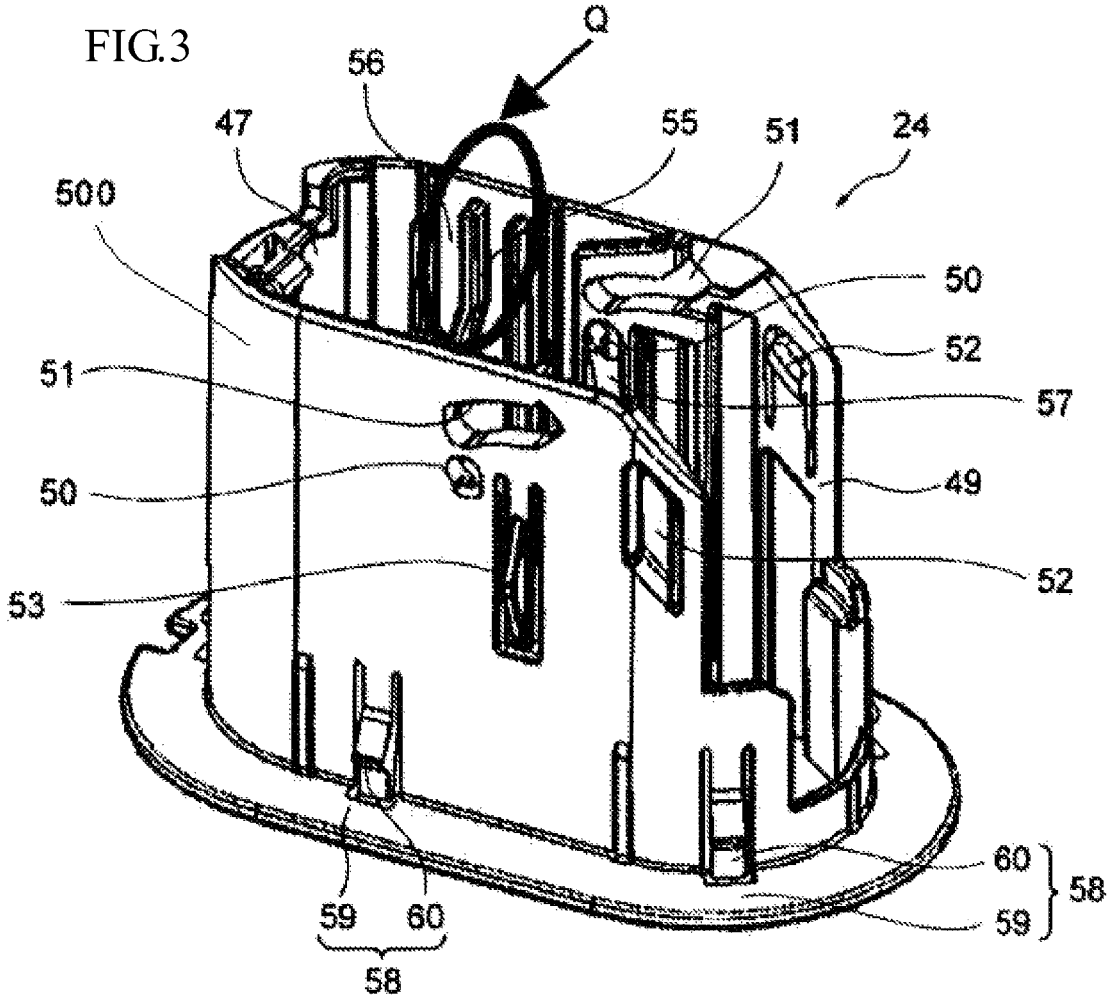
FIG. 3 is a perspective view of the lever member.
Figure 4:
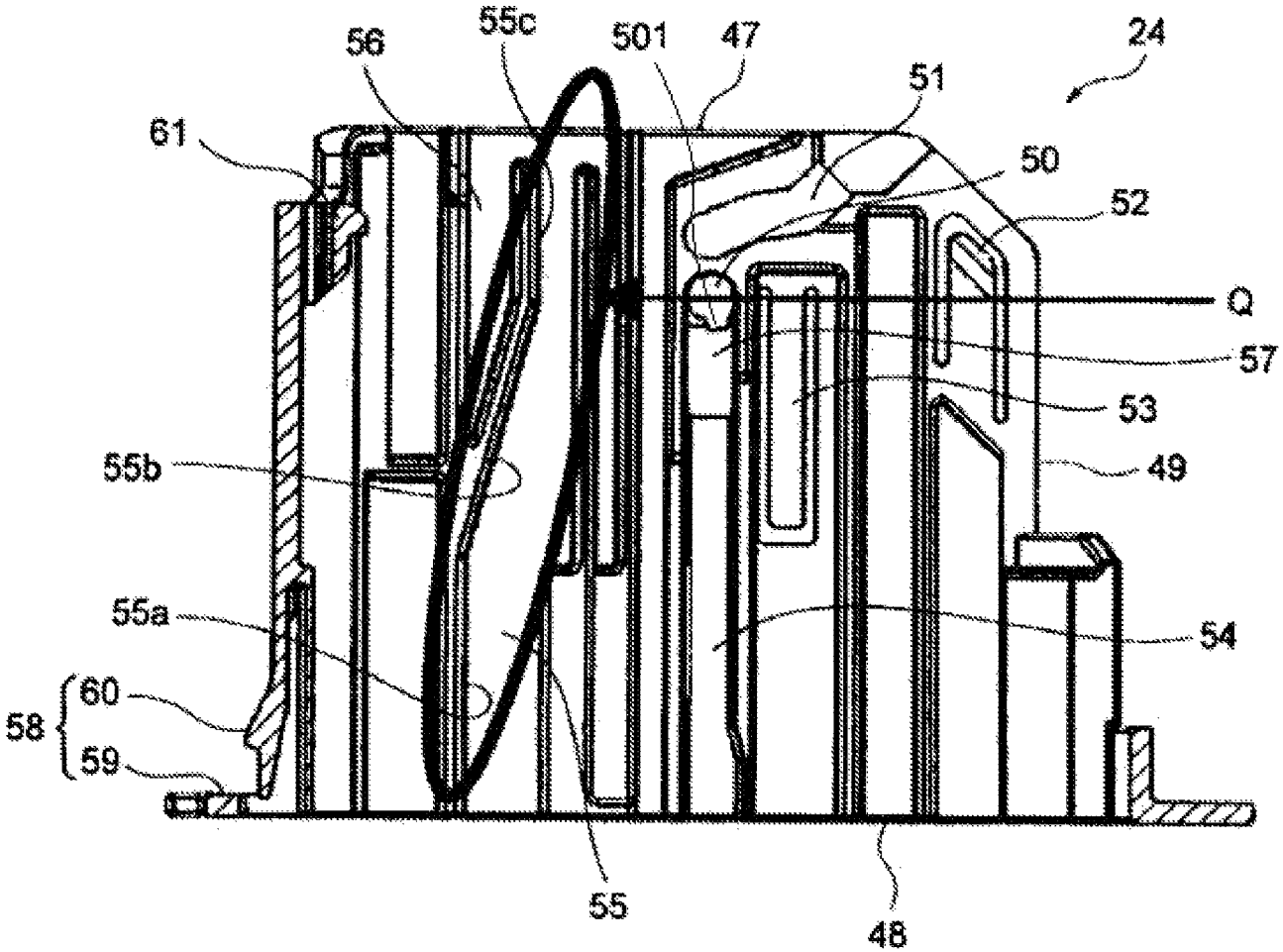
FIG. 4 is a cross-sectional view of the lever member.
Figure 5:
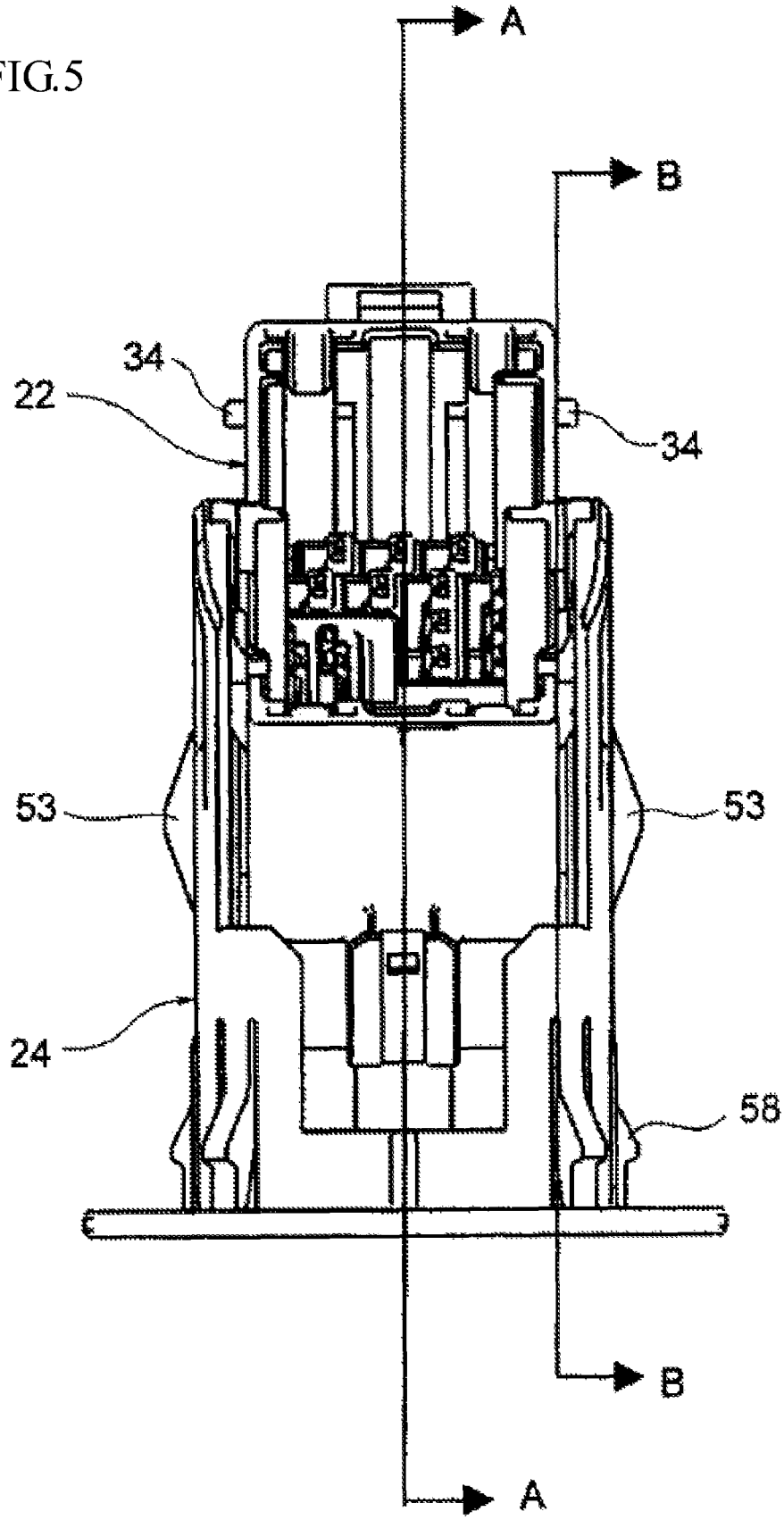
FIG. 5 is a side-elevational view showing a condition in which the first connector is being attached to the lever member.

FIG. 1 is a perspective view showing the first connector and the lever member of the LIF connector of the exemplary embodiment, and FIG. 2 is a perspective view showing the first connector and the second connector of the LIF connector of the exemplary embodiment. FIG. 3 is a perspective view of the lever member, FIG. 4 is a cross-sectional view of the lever member, FIG. 5 is a side-elevational view showing a condition in which the first connector is attached to the lever member, and FIGS. 6, 7A-7C, and 8A-8C are views explanatory of an operation for attaching the first connector to the lever member.

In FIGS. 2 and 3, the LIF connector of this embodiment has such construction and structure as to be retainingly mounted on a vehicle body panel (not shown) (which is one example of mounting members) of an automobile although not particularly limited to such construction and structure. The LIF connector 21 has a such construction and structure that the male and female multi-pole connectors (that is, the first and second connectors described later) each having many metal terminals can be fitted together with a low insertion force.

The LIF connector 21 comprises the first connector 22, the second connector 23, and the lever member 24. Thus, the LIF connector 21 comprises the three members (parts). The first connector 22 is received in the lever member 24 to be mounted therein. The first connector 22 and the second connector 23 can be fitted together by pivotally moving the lever member 24. When the first connector 22 and the second connector 23 are fitted together to form the LIF connector 21, this LIF connector 21 is fixed to the above vehicle body panel. First, each of the above three members are described below.

The first connector 22 includes a first connector housing 25 made of an insulative synthetic resin, a plurality of male metal terminals (not shown) received in the first connector housing 25. The male metal terminals are fixedly secured to end portions of wires, respectively. Thus, the first connector 22 is formed as the multi-pole connector having many male metal terminals. Although not particularly shown in the drawings, the wires are led out from a rear portion 26 of the first connector housing 25.

A connector fitting portion 27, into which the second connector 23 is fitted during the above described fitting operation, is formed at a front portion of the first connector housing 25. The connector fitting portion 27 has an opening (or open end) 28 corresponding in shape to the second connector 23. The connector fitting portion 27 has an internal space 29 formed between the open end 28 and an inner wall thereof. The male metal terminals (not show) project into the internal space 29. When the second connector 23 is inserted into the internal space 29 of the first connector 22 and is fitted to the first connector 22, the male metal terminals are contacted respectively with female metal terminals (not shown) of the second connector. Thus, the first connector 22 and the second connector 23 are electrically connected.

A fulcrum boss 31, an application point boss escape groove 32, a provisionally-retaining projection escape groove 33, a rotationally-mounting projection 34, a provisionally-retaining projection 35 and a bending limitation convex portion 36 are formed at each of a pair of outer surfaces 30 of the first connector hosing 25. A lock portion 38 is formed on another outer surface 37 of the first connector housing 25 disposed perpendicularly to the pair of outer surfaces 30. The fulcrum bosses 31, the provisionally-retaining projection escape grooves 33, the rotationally-mounting projections 34, the provisionally-retaining projections 35, and the bending limitation convex portions 36 act with the lever member 24, while the application point boss escape grooves 32 and the lock portion 38 act with the second connector 23.

Each fulcrum boss 31 is a projection having a round cross-section, and is formed at a generally central portion of the outer surface 30 of the first connector housing 25. A lever expansion prevention projection 39 and a tapered surface 40 are formed at a distal end of the fulcrum boss 31. The lever expansion prevention projection 39 projects in a direction perpendicular to the axis of the fulcrum boss 31. The lever expansion prevention projection 39 is formed as a small projection.

Each application point boss escape groove 32 is a groove-like (or slit-like) notch extending straight from the open end 28 of the connector fitting portion 27 to the vicinity of the fulcrum boss 31. Each provisionally-retaining projection escape groove 33 is formed at a region (position) corresponding to a position of provisionally-retaining of the first connector 22 and the lever member 24 (The provisional retaining will be described later). The provisionally-retaining projection escape groove 33 is a relative-short narrow notch extending straight from the open end 28.

Each rotationally-mounting projection 34 is a pin-like projection, and is formed at that portion of the outer surface 30 of the first connector housing 25 indicated by arrow P. The portion indicated by arrow P is disposed in the vicinity of the lock portion 38, and is closer to the open end 28 than to the fulcrum boss 31.

The provisionally-retaining projections 35 serve to provisionally retain the first connector 22 relative to the lever member 24 before the first connector 22 is fitted to the second connector 23. Each provisionally-retaining projection 35 is disposed adjacent to the provisionally-retaining projection escape groove 33. Each bending limitation convex portion 36 serves to prevent the bending (elastic deformation) of an arm portion 53 (described later) of the lever member 24. The bending limitation convex portion 36 is disposed generally at the rear side of the provisionally-retaining projection escape groove 33.

The second connector 23 includes a second connector housing 41 made of an insulative synthetic resin, and many female metal terminals (not shown) received in the second connector housing 41. The female metal terminals are fixedly secured to wires, respectively. Thus, the second connector 23 is formed as the multi-pole connector having many female metal terminals. Although not particularly shown in the drawings, the wires are led out from a rear portion of the second connector housing 41.

An application point boss 43 and a lever provisional-retainment cancellation projection 44 are formed on each of a pair of opposite outer surfaces 42 of the second connector housing 41. The application point boss 43 is a so-called cam, and is formed into a projection having a round cross-section. The application point boss 43 is formed at a generally central portion of the outer surface 42 of the second connector housing 41. The lever provisional-retainment cancellation projection 44 is formed at a position corresponding to the position of provisional retaining of the first connector 22 and the lever member 24. The lever provisional-retainment cancellation projection 44 is a projection to be inserted into the provisionally-retaining projection escape groove 33 of the first connector 22, and serves to cancel the provisionally-retained condition of the first connector 22 and the lever member 24.

A lock portion 46 is formed on another outer surface 45 of the second connector housing 41 disposed perpendicular to the pair of outer surfaces 42. When the second connector 23 is fitted to the first connector 22, the lock portion 46 is locked to the lock portion 38.

In FIGS. 1, 3 and 4, the lever member 24 functions as a lever for fitting the first connector 22 and the second connector 23 each other, and also functions as a connector holder for retaining the thus fitted first and second connectors 22 and 23 on the above vehicle body panel (not shown). The lever member 24 is formed, for example, into a generally tubular shape as shown in the drawings. The lever member 24 is formed into such a shape that the first connector 22 can be attached to the lever member 24 without using a jig.

The lever member 24 is open at its front side and rear side and also at part of its side (that is, its peripheral wall). Reference numeral 47 denotes a front opening portion, reference numeral 48 denotes a rear opening portion, and reference numeral 49 denotes a side opening portion formed in the peripheral wall. The lever member 24 includes a pair of facing walls 500 and a retaining structural portions 58.

On each of the facing walls of the lever member 24, a fulcrum boss guide hole 50, an application point boss guide groove 51, a provisionally-retaining projection 52, and the arm portion 53, and are formed in a vicinity of the opening portion 47 of the lever member 24 and the vicinities thereof. Each fulcrum boss guide hole 50 corresponds in shape and disposition to the fulcrum boss 31 of the first connector 22.

The shape of the fulcrum boss guide hole 50 is described more detail below. The fulcrum boss guide hole 50 is a substantially circular hole (see FIGS. 3 and 4), and is provided with a projection escape portion (not designated by a reference numeral) for the lever expansion prevention projection 39 of the fulcrum boss 31, and a projection engagement recess (not designated by a reference numeral) as a space to be engaged with the lever expansion prevention projection 39 at an edge portion of the fulcrum boss guide hole 50. The projection engagement recess is formed at the outer edge portion of the fulcrum boss guide hole 50. The lever expansion prevention projection 39 is engaged in the projection engagement recess (When the lever expansion prevention projections 39 are engaged in the respective projection engagement recesses, the lever member 24 is prevented from being expanded (that is, the facing walls 500 of the lever member 24 are prevented from being moved away from each other).

Each application point boss guide groove 51 is a groove-like notch inclined and extending from the opening portion 47 to the vicinity of the fulcrum boss guide hole 50. The fulcrum boss guide groove 51 is a so-called cam groove. When the lever member 24 is disposed in the provisionally-retained condition relative to the first connector 22, the application point boss guide grooves 51 overlap the application point boss guides 32 of the first connector 22, respectively.

The provisionally-retaining projections 52 provisionally retain the lever member 24 relative to the first connector 22, and are adapted so as to catch the respective provisionally-retaining projections 35 of the first connector 22. Each arm portion 53 is an elastic arm having a projection projecting outwardly. When the first connector 22 and the second connector 23 are not disposed in the fitted condition, the elastic deformation (bending) of the arm portion 53 is prevented by the bending limitation convex portion 36 so that the LIF connector 21 can not be fixed to the vehicle body panel (not shown).

The opening portion 48 of the lever member 24 serves as a first connector introduction port through which the first connector 22 can be inserted into the lever member 24. Also, the wires extending from the first connector 22 are led out from the LIF connector 21 through this opening portion 48.

A pair of fulcrum boss introduction guide grooves 54 are formed in the inner surface of the lever member 24 and extend straight from the opening portion 48 toward the respective fulcrum boss guide holes 50. A pair of rotationally-mounting portions 55, each of which has a portion not parallel to the fulcrum boss introduction guide groove 54, are formed on the inner surface of the lever member 24 and extend from the opening portion 48. A pair of post-fitting mounting grooves 56 are formed on the inner surface of the lever member 24 and disposed adjacent respectively to the rotationally-mounting portions 55. Further, a pair of fulcrum boss passage portions 57 are formed on the inner surface of the lever member 24, and each fulcrum boss passage portion 57 is disposed between the corresponding fulcrum boss introduction guide groove 54 and the corresponding fulcrum boss guide hole 50. During the insertion of the first connector 22 into the lever member 24, the fulcrum bosses 31 slide over the fulcrum boss passage portions 57, respectively.

The fulcrum boss introduction guide grooves 54 serve to guide the respective fulcrum bosses 31 of the first connector at the time when the first connector 22 is inserted into the lever member 24. Each of the fulcrum boss introduction guide grooves 54 also prevents the lever member 24 from being deformed and expanded by the fulcrum bosses 31 during insertion of the first connector 22. On the other hand, the fulcrum boss passage portions 57 instantaneously deform and expand the lever member 24 at the time when the fulcrum bosses 31 slide over the respective fulcrum boss passage portions 57. The fulcrum boss passage portion 57 is formed into a tapered shape such that the tapered surface 40 of the fulcrum boss 31 can be brought into sliding contact with the fulcrum boss passage portion 57. Therefore, the fulcrum boss 31 smoothly slides over the fulcrum boss passage portion 57, and is fitted into the fulcrum boss guide hole 50.

The rotationally-mounting portions 55 guide the respective rotationally-mounting projections 34 of the first connector 22. The rotationally-mounting portion 55 is disposed adjacent to the fulcrum boss introduction guide groove 54 as described above. The rotationally-mounting portion 55 includes a parallel portion 55*a* disposed parallel to the fulcrum boss introduction guide groove 54 and extending from the opening portion 48, a inclined portion 55*b* (inclined relative to the fulcrum boss introduction guide groove 54) extending from the parallel portion 55*a*, and a parallel portion 55*c* (parallel to the fulcrum boss introduction guide groove 54) extending from the non-parallel portion 55*b*. The rotationally-mounting portion 55 has a rib-like shape (or can be regarded as having a groove-like shape including the rib-like shape) as indicated by arrow Q. During the insertion of the first connection 22 into the lever member 24, the inclined portions 55*b* of the pair of rotationally-mounting portions 55 automatically rotate (or angularly move) the first connector 22 by a predetermined angle. The post-fitting mounting groove 56 of a groove-like shape is disposed adjacent to the parallel portion 55*c* in parallel relation thereto.

A plurality of retaining structural portions 58 retain the lever member 24 to the vehicle body panel (not shown). The retaining structure portions 58 are formed at the lever member 24 and are disposed adjacent to the opening portion 48. The retaining structural portion 58 includes a panel butt-mounting flange 59, and a panel retaining arm 60. The panel butt-mounting flange 59 and each panel retaining arm 60 are so disposed as to hold the vehicle body panel therebetween.

The panel butt-mounting flange 59 is formed into such a flange-shape as to be held in surface-to-surface contact with the vehicle body panel. The panel retaining arm 60 has a retaining portion for retaining engagement with the vehicle body panel. The panel retaining arm 60 is formed into a cantilever arm-shape. The panel retaining arm 60 can be elastically deformed so as to cancel its retained condition to the panel.

Here, the supplemental explanation about the first connector 22, the second connector 23 and the lever member 24 will be additionally described in below. The fulcrum bosses 31, the application point boss escape grooves 32, the application point bosses 43, the fulcrum boss guide holes 50 and the application point guide grooves 51 collectively form an LIF mechanism for fitting the first connector 22 and the second connector 23 together with a low insertion force.

The above vehicle body panel (not shown) is provided, for example, at a door of the automobile or a portion between an engine room and a passenger compartment, and has a predetermined thickness. This vehicle body panel has a flat surface. The vehicle body panel has a panel through hole formed therethrough. When the LIF connector 21 of the exemplary embodiment is inserted into the panel through hole, the LIF connector 21 is retained on a peripheral edge portion of the panel through hole to be fixed thereto.

Next, the operation for attaching the first connector 22 to the lever member 24 in the assembling operation of the LIF connector 21 of the invention will be described.

Figure 6C:
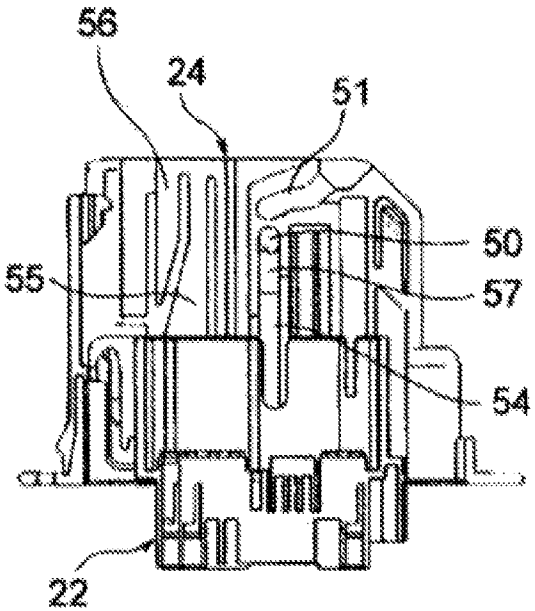
FIGS. 6A to 6C are cross-sectional views taken along the line A-A of FIG. 5, showing a first step to an intermediate step of the process of attaching the first connector to the lever member.
Figure 6B:
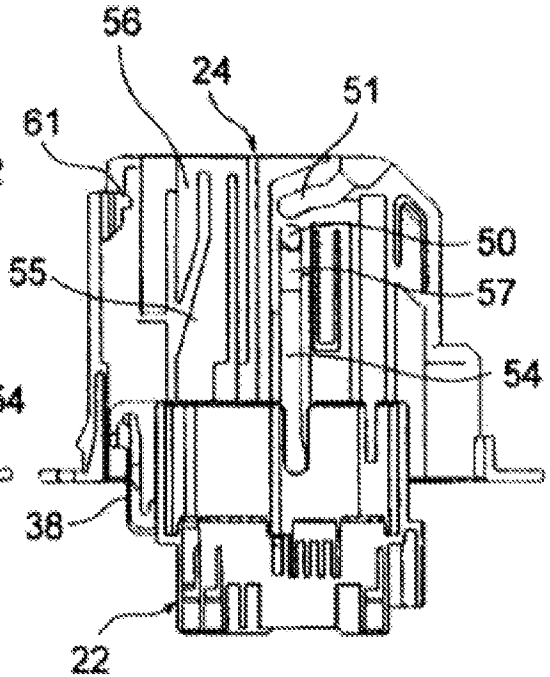
Figure 6A:
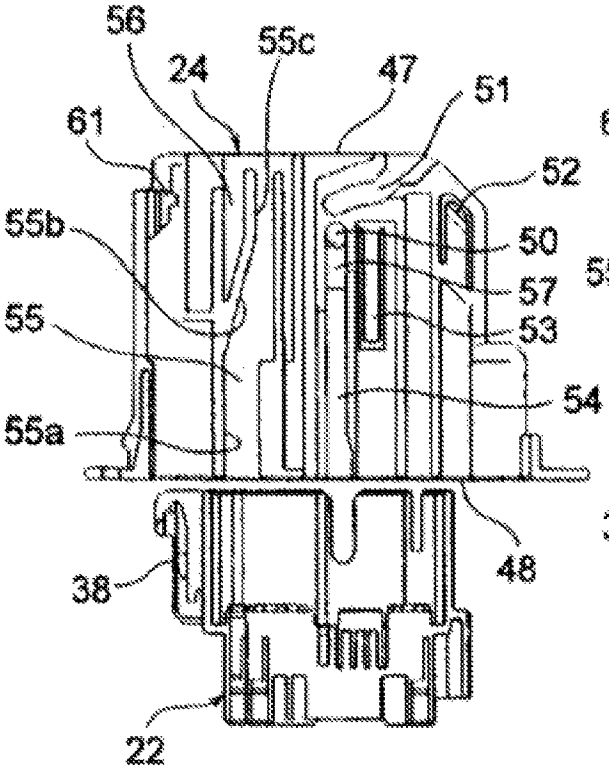
Figure 7A:
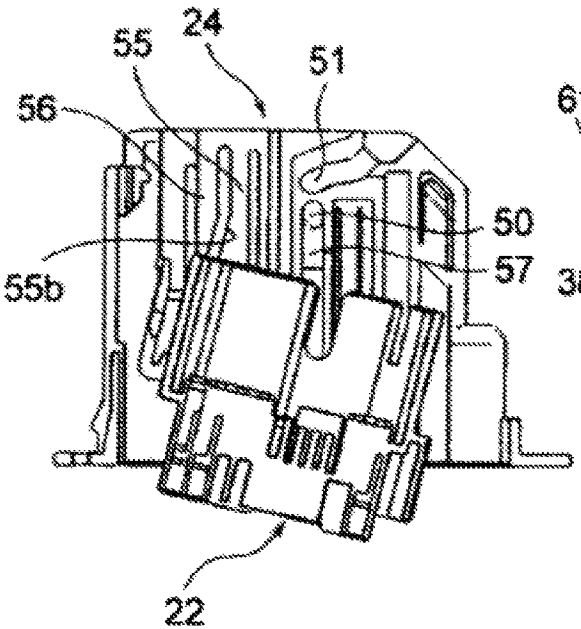
FIGS. 7A to 7C are cross-sectional views taken along the line A-A of FIG. 5, showing the intermediate step to a final step of the process of attaching the first connector to the lever member.
Figure 7B:
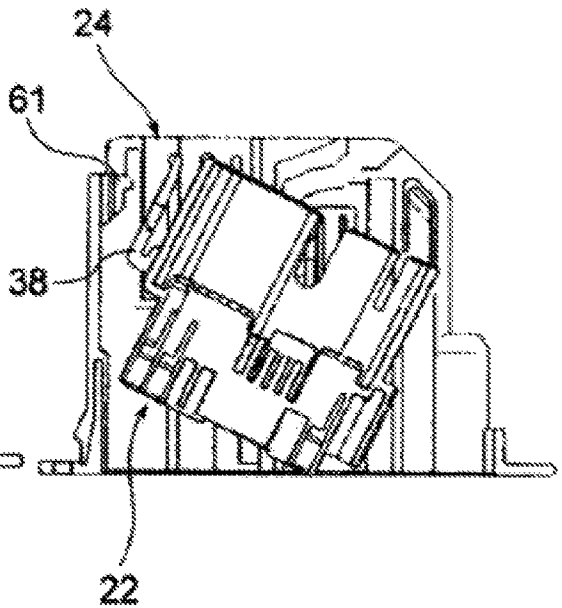
Figure 7C:
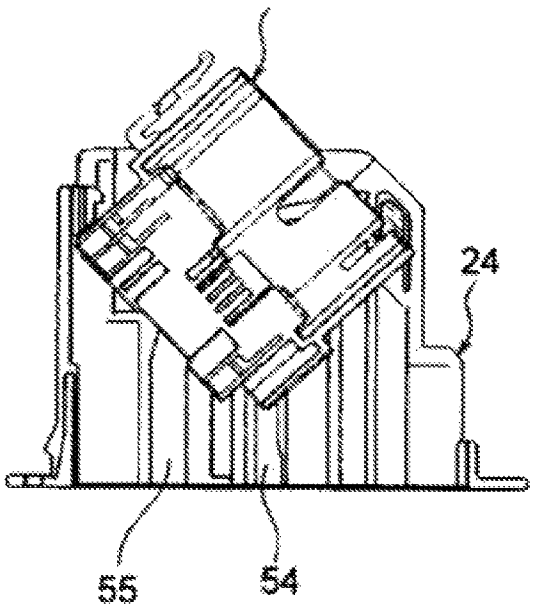
Figure 8C:
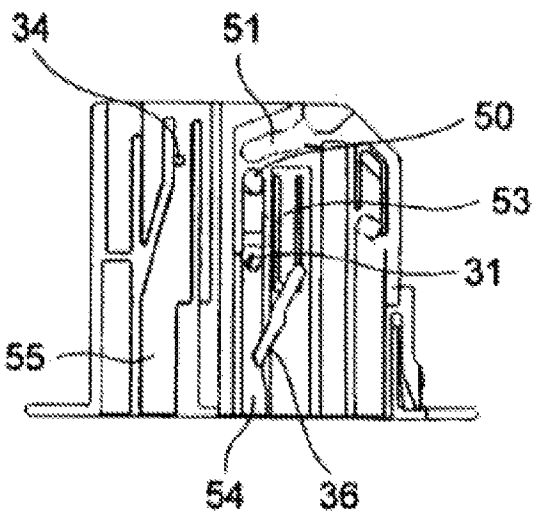
FIGS. 8A to 8C are cross-sectional views taken along the line B-B of FIG. 5, showing the first step to the intermediate step of the process of attaching the first connector to the lever member.
Figure 8B:
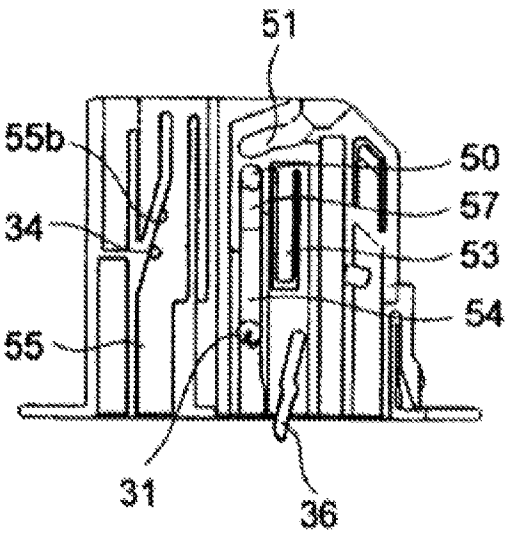
Figure 8A:
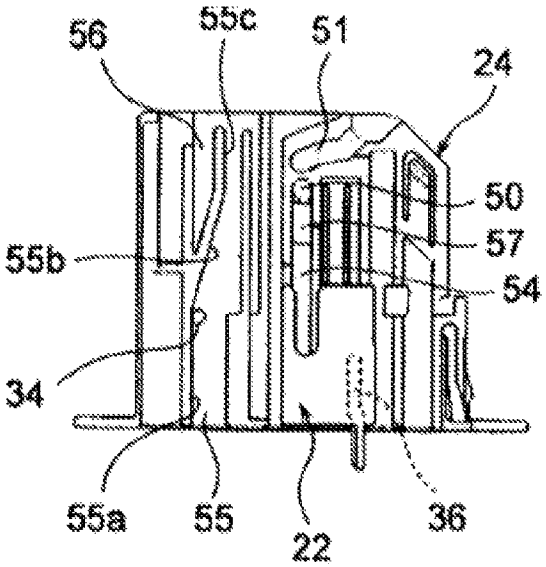
Figure 9:
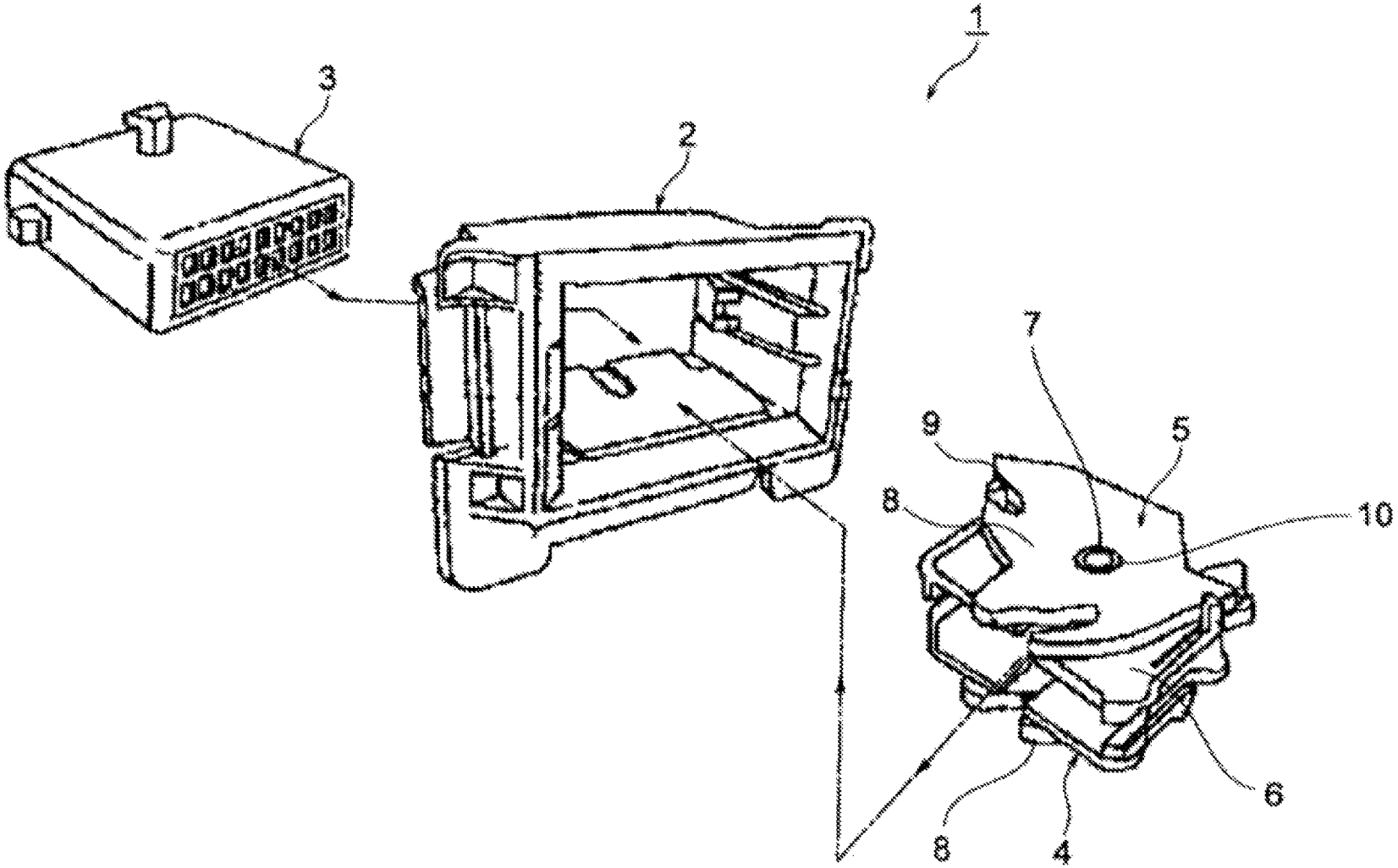
FIG. 9 is an exploded perspective view of a conventional LIF connector.

In FIGS. 1 and 6, first, the first connector 22 is located at the rear side of the opening portion 48 of the lever member 24. When the first connector 22 is inserted straight into the interior of the lever member 24, each fulcrum boss 31 is guided straight to the fulcrum boss passage portion 57 by the fulcrum boss introduction guide groove 54. Then, when the fulcrum boss 31 slides over (or passes past) the fulcrum boss passage portion 57, the fulcrum boss 31 is fitted into the fulcrum boss guide hole 50. As a result, the attaching of the first connector 22 to the lever member 24 is completed. The LIF connector 21 of the exemplary embodiment presents the following features during the above attaching operation.

In FIGS. 1, 5, 6 and 7, each rotationally-mounting projection 34 of the first connector 22 is guided by the parallel portion 55*a* of the rotationally-mounting portion 55 of the lever member 24 during above described insertion of the first connector 22 into the lever member 24. Subsequently, the rotationally-mounting projection 34 is guided sequentially by the inclined portion 55*b* and the parallel portion 55*c* extending from the non-parallel portion 55*b*. When the rotationally-mounting projection 34 is guided by the non-parallel portion 55*b*, the first connector 22 is rotated (or angularly moved) through the predetermined angle about the fulcrum boss 31 (that is, the first connector 22 is rotated into a position where the first connector 22 assumes such a posture as to be suitably fitted to the second connector 23).

When the first connector 22 is thus rotated, and its posture is changed, the position of the lock portion 38 of the first connector 22 is also changed, and therefore the lock portion 38 will not interfere with a front end portion 61 of the lever member 24.

When the rotationally-mounting projection 34 is guided by the parallel portion 55*c*, the above posture of the first connector 22 is maintained until the fulcrum boss 31 is fitted into the fulcrum boss guide hole 50. When the attaching of the first connector 22 to the lever member 24 is completed, the first connector 22 kept in this condition can be fitted to the second connector 23. (first position) (Although not described in detail, the first connector 22 and the lever member 24 are provisionally retained relative to each other by the engagement of the provisionally-retaining projections 35 with the respective provisionally-retaining projections 52. As a result, the lever member 24 will not accidentally rotate).

When the operation for attaching the first connector 22 to the lever member 24 proceeds, each bending limitation convex portion 36 of the first connector 22 overlaps the back side of the arm portion 53 of the lever member 24 to limit or prevent the bending (or elastic deformation) of the arm portion 53. In the exemplary embodiment, when the bending of the arm portions 53 are thus limited, the LIF connector 21 can not be retained on the vehicle body panel (not shown) to be fixed thereto unless the first connector 22 and the second connector 23 are fitted together (Even when the outwardly projecting projections of the arm portions 53 are brought into abutting engagement with the edge portion of the panel through hole in the vehicle body panel, the LIF connector 21 can not be inserted into the panel through hole any further since the bending of each arm portion 53 is prevented, and as a result the LIF connector 21 can not be retained on the vehicle body panel.).

Next, the operation for fitting the first connector 22 and the second connector 23 together in the assembling operation of the LIF connector 21 of the invention will be described.

Although not shown in the drawings, when the second connector 23 is inserted into the connector fitting portion 27 of the first connector 22 held in the above provisionally-retained condition, the fitting of the first and second connectors 22 and 23 to each other begins. More specifically, when the second connector 23 is inserted into the connector fitting portion 27, each lever provisional-retainment cancellation projection 44 of the second connector 23 is brought into abutting engagement with the provisionally-retaining projection 52 of the lever member 24 to move this projection 52 outwardly. As a result, the above provisionally-retained condition is canceled, so that the lever member 24 can rotate.

When the lever member 24 is operated so as to rotate, the above LIF mechanism functions in accordance with this pivotal movement, and the second connector 23 is drawn toward the first connector 22. Therefore, the second connector 23 is fitted into the first connector 22, thus completing a series of steps of the assembling operation of the LIF connector 21 of the invention. (second position)

After assembling of LIF connector 21, when the LIF connector 21 is inserted into the panel through hole in the vehicle body panel (not shown), the LIF connector 21 is retained on the vehicle body panel to be fixed thereto by the retaining structural portions 58.

As described above with reference to FIGS. 1 to 8, the LIF connector 21 of the exemplary embodiment includes the pair of fulcrum bosses 31, the pair of rotationally-mounting projections 34, the pair of fulcrum boss guide holes 50, the pair of fulcrum boss introduction guide grooves 54, the pair of fulcrum boss passage portions 57, and the pair of rotationally-mounting portions (projection introduction guide portions) 55. With this construction, the operation for attaching the first connector 22 to the lever member 24 can be more easily performed as compared to the related connector. Namely, it is not necessary to use a jig for the attaching operation, and therefore the efficiency of the attaching operation can be more enhanced as compared to the related connector.

Furthermore, in the LIF connector 21 of the exemplary embodiment, since the first connector 22 is automatically rotated by the predetermined angle during the operation for attaching the first connector 22 to the lever member 24, and therefore the lever member 24 can be prevented from interfering with the lock portion 38 of the first connector 22 without the need for increasing the size of the lever member 24. Therefore, the size of the lever member 24 and hence the size of the LIF connector 21 can be reduced.

Furthermore, in the LIF connector 21 of the exemplary embodiment, by further providing the post-fitting mounting grooves (second projection introduction guide portions) 56, unnecessary rotation of the first and second connectors 22 and 23 in the fitted condition can be prevented.

Furthermore, in the LIF connector 21 of the exemplary embodiment, the lever member 24 functions also as the connector holder, and therefore the number of the component parts or members of the LIF connector adapted to be retained on the mounting member (such as the above vehicle body panel) can be reduced as compared with the conventional connector. Thus, there can be provided the LIF connector 21 having a reduced number of component parts.

The present invention is not limited to the above embodiment, and various modifications can be made without departing from the subject matter of the invention.

The invention claimed is:

1. A connector comprising:

a first connector provided with a first projection and a second projection on an outer surface thereof; and a frame including a wall portion defining an opening, the wall portion provided with a first guide running in a direction and a second guide on an inner surface thereof, wherein the first connector is inserted into the frame through the opening along the direction while the first projection is guided by the first guide and the second projection is guided by the second guide, and at least a part of a distance between the first guide and the second guide shortens along the direction such that the first connector is automatically rotated with respect to the frame during insertion.

2. The connector according to claim 1, wherein the first guide comprising:

a first guide groove;

a guide hole; and a projection path having a tapered surface and provided between the guide groove and the guide hole.

3. The connector according to claim 2, wherein the first projection is provided with an projection which is projected from a tip of the first projection, and the guide hole is provided with a space to which the projection is fitted.

4. The connector according to claim 1, wherein the second guide comprising:

a first parallel portion running in the direction;

an inclined portion continued from the first parallel portion and inclined from the direction; and a second parallel portion running in the direction and continued from the inclined portion.

5. The connector according to claim 1, wherein a pair of the first projections are provided on the outer surface of the first connector.

6. The connector according to claim 1, wherein a pair of the second projections are provided on the outer surface of the first connector.

7. The connector according to claim 2 comprising:

the first connector provided with a second guide groove;

the frame provided with a third guide groove, the third guide groove having a first end and a second end, a distance between the guide hole and the third guide groove lengthening from the first end to the second end; and a second connector provided with a third projection, the third projection engaged with the first end while the first connector in a first position and engaged with the second end while the first connector in a second position, wherein the first connector is rotatable about the guide hole at least from the second position to the first position.

8. The connector according to claim 7, wherein the frame includes a third guide on the inner surface thereof, the third guide guiding the second projection when the first connector rotate from the second position to the first position.

9. The connector according to claim 8, wherein the third guide is adjacent to the second guide.

10. The connector according to claim 7, wherein the frame has a tubular shape so as to receive the first and the second connectors in the first position, an arm for retaining the frame to a panel of vehicle and a flange for retaining the frame to the panel.

* * * * *